US006077060A

United States Patent [19]

Watanabe

[11] Patent Number: 6,077,060

[45] Date of Patent: Jun. 20, 2000

[54] SCROLL-TYPE FLUID MACHINE INCLUDING FLOAT-PROTECTING PIN HAVING PARTIALLY-CUT HEAD

[75] Inventor: Kazuhide Watanabe, Nishi-kasugai-gun, Japan

[73] Assignee: Mitsubishi Heavy Industries, Ltd., Tokyo, Japan

[21] Appl. No.: 09/169,131

[22] Filed: Oct. 9, 1998

[30] Foreign Application Priority Data

Oct. 28, 1997 [JP] Japan ..... 9-311060

[51] Int. Cl.[7] ..... F01C 21/00

[52] U.S. Cl. ..... 418/151; 418/55.1; 418/55.6; 418/55.5

[58] Field of Search ..... 418/55.1, 151, 418/55.6, 55.5

[56] References Cited

U.S. PATENT DOCUMENTS

| | | | |
|---|---|---|---|
| 5,458,472 | 10/1995 | Kobayashi et al. | 418/55.5 |
| 5,531,578 | 7/1996 | Takemoto et al. | 418/55.1 |
| 5,542,830 | 8/1996 | Yuzaki | 418/55.6 |

FOREIGN PATENT DOCUMENTS

| | | | |
|---|---|---|---|
| 0 489 479 | 6/1992 | European Pat. Off. . | |
| 0 558 167 | 9/1993 | European Pat. Off. . | |
| 5-99167 | 4/1993 | Japan . | |
| 405231358 | 9/1993 | Japan | 418/151 |
| 6-93983 | 4/1994 | Japan . | |
| 406173866 | 6/1994 | Japan | 418/151 |
| 7-317666 | 12/1995 | Japan . | |

*Primary Examiner*—Thomas Denion
*Assistant Examiner*—Thai-Ba Trieu
*Attorney, Agent, or Firm*—Oblon, Spivak, McClelland, Maier & Neustadt, P.C.

[57] ABSTRACT

A scroll-type fluid machine is provided, which comprises a boss provided in and projecting from a central area in a surface of the end plate of a revolving scroll; a drive bush inserted into the boss in a freely rotatable form; a rotational shaft co-rotationally coupled with the revolving scroll via a revolving-radius variable mechanism; a balance weight attached to the drive bush; and a float-protecting pin, a part of the back face of the head of the pin being in contact with the upper face of the balance weight, the shaft of this pin passing through a hole provided in the balance weight in a freely movable form, and an end part of the shaft being fixed to a larger-diameter portion at one end of the rotational shaft, said larger-diameter portion existing at the drive bush side. In the above structure, a part of the head of the pin, said part existing at the side of the drive bush, is cut. Accordingly, the attachment position of the pin can be closer to the drive bush side, the size of the structure in an area neighboring the pin can be reduced, and the diameter of the shaft of the pin can become larger so as to strengthen the shaft.

5 Claims, 2 Drawing Sheets

SCROLL-TYPE FLUID MACHINE INCLUDING FLOAT-PROTECTING PIN HAVING PARTIALLY-CUT HEAD

BACKGROUND OF THE INVENTION

1. Field of the Invention

The present invention relates to a scroll-type fluid machine used as a compressor or an expander.

This application is based on Patent Application No. Hei 9-311060 filed in Japan, the contents of which are incorporated herein by reference.

2. Description of the Related Art

FIG. 3 shows an example of a conventional scroll-type fluid machine.

In the figure, reference numeral 1 indicates a housing comprising cup-like main body 2 and front housing 6 which is fastened to main body 2 using a bolt (not shown). Rotational shaft 7 which passes through the front housing 6 is supported by this front housing 6 via bearings 8 and 9, in a freely rotatable form.

Fixed scroll 10 and revolving scroll 14 are provided inside the housing 1. This fixed scroll 10 comprises end plate 11 and spiral lap 12 disposed on surface 11*a* of the plate 11, the surface facing end plate 15 explained later. The end plate 11 is fastened to cup-like main body 2 via bolt 13.

In the above structure, the outer-peripheral surface of the end plate 11 is in close contact with the inner-peripheral surface of the cup-like main body 2, and thereby internal partition of housing 1 is established in a manner such that discharge cavity 31 is limitedly provided outside the end plate 11, while suction chamber 28 is limitedly provided inside the end plate 11.

On the other hand, a central part of end plate 11 is bored to provide discharge port 29, and opening and closing operations of this discharge port 29 are performed using discharge valve 30. The rising motion of discharge valve 30 is restricted by valve presser 32, and one end of both discharge valve 30 and valve presser 32 are fastened to end plate 11 via bolt 33.

The revolving scroll 14 comprises end plate 15 and spiral lap 16 which is disposed on surface 15*a* of the plate 15, the surface facing the end plate 11. This spiral lap 16 has substantially the same shape as spiral lap 12 included in fixed scroll 10. The axes of the revolving and fixed scrolls 14 and 10 are eccentrically separated from each other by a predetermined distance, that is, they are in an eccentric form. In addition, phases of these scrolls are different from each other by 180°, and are engaged with each other as shown in FIG. 3.

Accordingly, tip seals 17, provided and buried at each head surface of spiral lap 12, are in close contact with surface 15*a* of end plate 15, while tip seals 18, provided and buried at each head surface of spiral lap 16, are in close contact with surface 11*a* of end plate 11. The side faces of spiral laps 12 and 16 have line contact at plural positions and thus plural compression chambers 19*a* and 19*b* are formed essentially at positions of point symmetry with respect to the center of the spiral.

Inside projecting disk-shaped boss 20, provided at a center area in the outer surface (opposite to inner surface 15*a*) of end plate 15, drive bush 21 is inserted in a freely rotatable form via revolving bearing 23. Slide groove 24 is cut into the drive bush 21, and eccentric drive pin 25 is inserted into the slide groove 24 so as to perform a sliding motion of the pin. The projecting drive pin 25 is eccentrically provided on an end face of larger-diameter portion 7*a* of rotational shaft 7, the portion 7*a* being provided on an end at the main body 2 side of the rotational shaft 7.

Between the peripheral edge of the outer surface of end plate 15 and an inner end face of front housing 6, thrust bearing 36 and Oldham link 26 are inserted. In order to balance a dynamically unbalanced situation due to a revolving motion of the revolving scroll 14, balance weight 27 is attached to drive bush 21, and balance weight 37 is attached to the rotational shaft 7.

According to the above structure, when the rotational shaft 7 is rotated, revolving scroll 14 is driven via a revolving-radius variable mechanism consisting of eccentric drive pin 25, slide groove 24, drive bush 21, revolving bearing 23, boss 20, etc. The revolving scroll 14 revolves along a circular orbit having a radius of revolution, while rotation of the scroll 14 is prohibited by the Oldham link 26.

In this way, the above-mentioned line-contact portions in the side faces of spiral laps 12 and 16 gradually move toward the center of "swirl", and thereby compression chambers 19*a* and 19*b* also move toward the center of the swirl while the volume of each chamber is gradually reduced.

Accordingly, gas, which has flowed into suction chamber 28 through an inlet (not shown), enters from an opening which is limitedly established by outer peripheral edges of spiral laps 12 and 16 to compression chambers 19*a* and 19*b*. This gas is gradually compressed and reaches central chamber 22. From the central chamber, the gas passes through discharge port 29, and presses and opens discharge valve 30, and thereby the gas is discharged into discharge cavity 31. The gas is then discharged outside via an outlet not shown.

At the time of operating the scroll-type compressor, when revolving scroll 14 revolves, balance weight 27 floats from the end face of larger-diameter portion 7*a* of the rotational shaft 7, and accordingly, drive bush 21 and revolving scroll 14 are inclined.

This inclination of revolving scroll 14 causes a situation in which the head or root portion of the side face of spiral lap 16 comes into partial contact with the side face of spiral lap 12 of fixed scroll 11. Therefore, not only abnormal abrasion between these sliding side faces is caused, but also volumetric efficiency of the scroll-type compressor is degraded due to leakage of gas from a gap generated between these sliding faces. In addition, slide portions such as thrust bearing 36, Oldham link 26, and revolving bearing 23 may not uniformly contact with an opposite portion in each relevant sliding motion, and thereby abnormal abrasion and seizure occur.

In consideration of the above situations, hole 38 is provided in balance weight 27 as shown in FIG. 2A, and the head of float-protecting pin 40, which passes through this hole 38 in a freely movable form, is pressed and fixed to hole 39 provided in larger-diameter portion 7*a* of rotational shaft 7. Regarding the back face of head 40*a* of this float-protecting pin 40, as shown in FIG. 2B, a portion of its peripheral area, existing at the opposite side to the drive bush 21, is in contact with an upper surface 27*a* of balance weight 27, so as to prevent the balance weight 27 from floating from the end face of the larger-diameter portion 7*a* of rotational shaft 7.

In the above-explained conventional scroll-type compressor, shaft 40*b* of the float-protecting pin 40 is fixed to the larger-diameter portion 7*a* of rotational shaft 7 and the head 40*a* of the pin has a circular shape of a predetermined diameter. Therefore, there occurs a problem in which restrictions are imposed on the structure, shape, size, and attachment position of the float-protecting pin 40.

SUMMARY OF THE INVENTION

An object of the present invention is to provide a scroll-type fluid machine by which the above problem can be solved.

Accordingly, the present invention provides a scroll-type fluid machine comprising:

a fixed scroll and a revolving scroll, each scroll comprising an end plate on which a spiral lap is built, and these scrolls are eccentrically engaged in a manner such that both spiral laps are engaged with each other and that phases of these scrolls are different from each other;

a boss provided in and projecting from a central area in a surface of the end plate of the revolving scroll, said surface being opposite to the surface on which the spiral lap is built;

a drive bush inserted into the boss in a freely rotatable form;

a rotational shaft co-rotationally coupled with the revolving scroll via a revolving-radius variable mechanism which includes the boss and the drive bush;

a balance weight attached to the drive bush; and a float-protecting pin, a part of the back face of the head of the pin being in contact with the upper face of the balance weight, the shaft of this pin passing through a hole provided in the balance weight in a freely movable form, and an end part of the shaft being fixed to a larger-diameter portion at one end of the rotational shaft, said larger-diameter portion existing at the drive bush side, and wherein a part of the head of the float-protecting pin, said part existing at the side of the drive bush, is cut.

In a typical form, the head of the float-protecting pin is cut so that the position of the outer edge at the drive bush side of the head of the float-protecting pin essentially agrees with the corresponding position at the drive bush side of the outer peripheral surface of the shaft of the pin.

According to the above structure, the attachment position of the float-protecting pin can be closer to the drive bush side by a distance corresponding to a cut portion. Therefore, the sizes of structural elements in an area neighboring the float-protecting pin can be reduced. In addition, the diameter of the shaft of the float-protecting pin can become larger and thus the strength of the shaft can be increased.

BRIEF DESCRIPTION OF THE DRAWINGS

FIG. 1A is a partially enlarged sectional view, and FIG. 1B is a view observed in a direction indicated by arrow B in FIG. 1A.

DESCRIPTION OF THE PREFERRED EMBODIMENTS

Figure 1A:
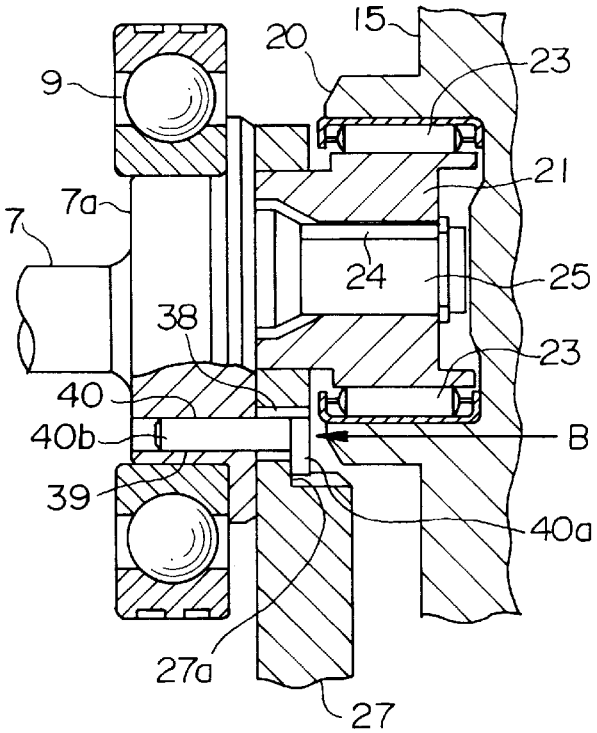
FIGS. 1A and 1B shows an embodiment according to the present invention.
Figure 1B:
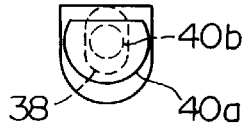

An embodiment of the present invention is shown in FIGS. 1A and 1B. FIG. 1A is a partially enlarged sectional view, and FIG. 1B is a view observed in a direction indicated by arrow A in FIG. 1A.

In this embodiment, regarding the head 40*a* of float-protecting pin 40, a part at the drive bush (21) side is cut so that the position (or height in the figures) of the outer edge at the drive bush side of the head 40*a* almost agrees with the corresponding position at the drive bush side of the outer peripheral surface of shaft 40*b* of the pin.

Figure 2A:
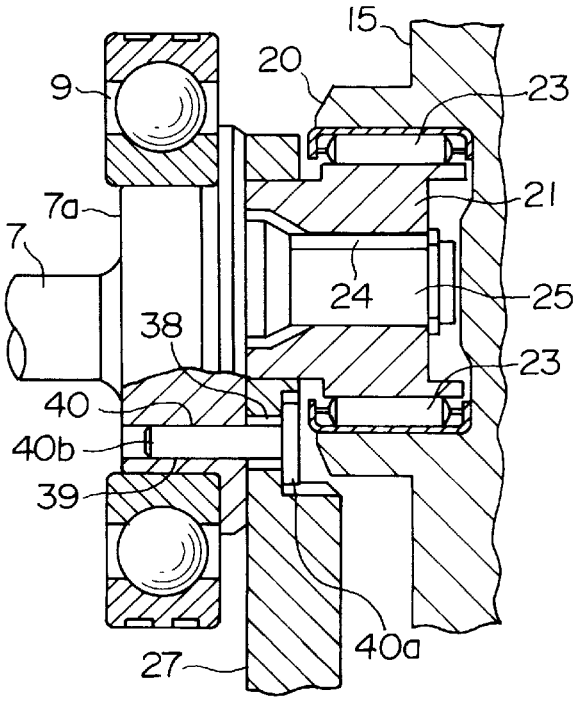
FIG.2A (PRIOR ART)
FIG. 2A is a partially enlarged sectional view of a conventional example, showing an area neighboring the float-protecting pin.
Figure 2B:
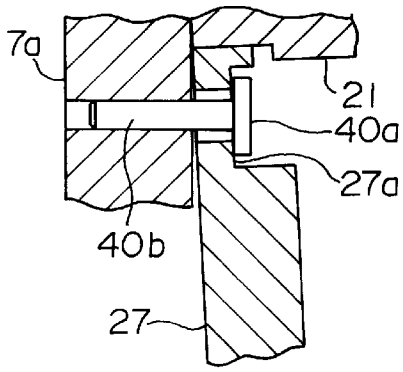
FIG.2B (PRIOR ART)
FIG. 2B is a partially enlarged view showing a state in which the balance weight floats.
Figure 3:
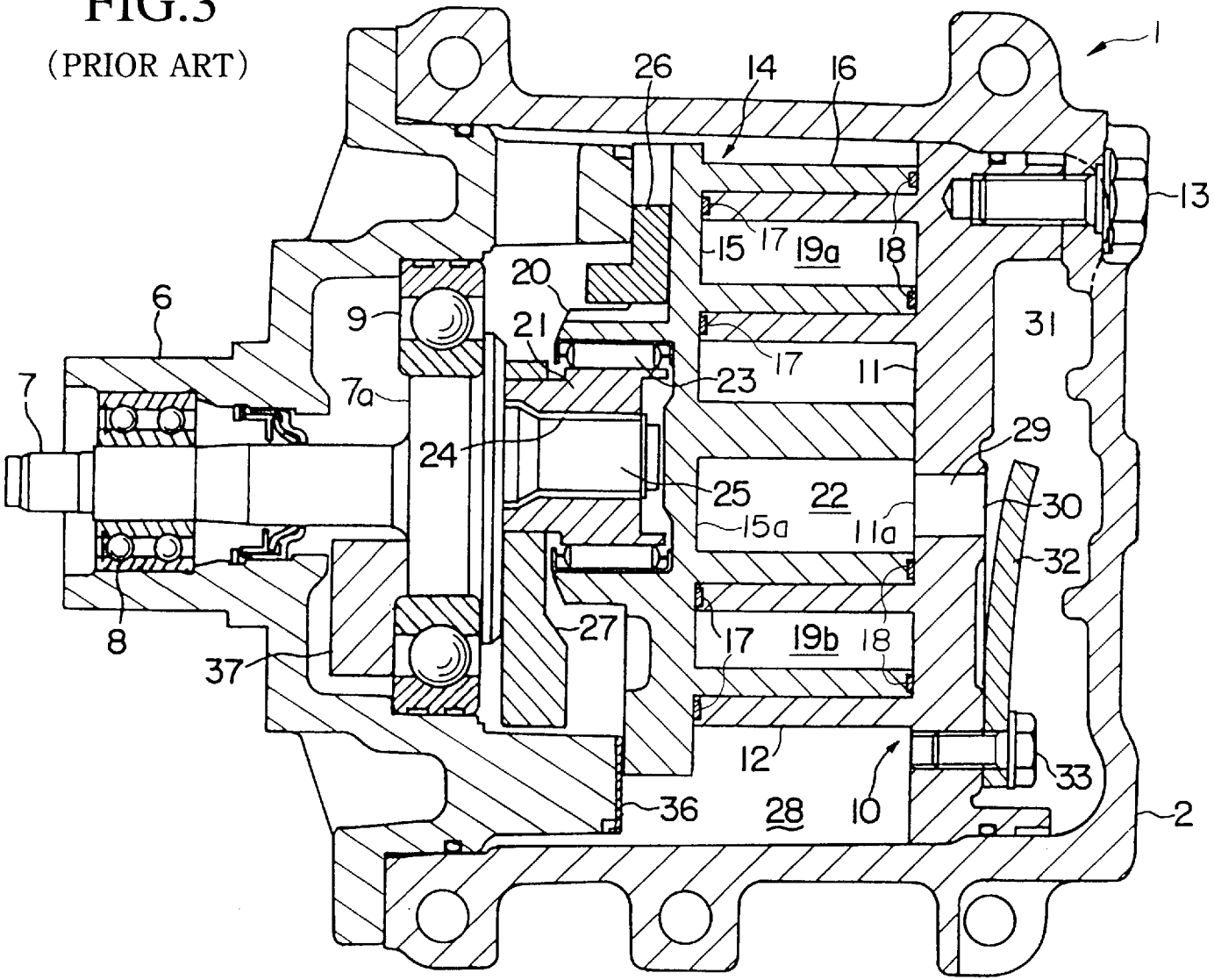
FIG.3 (PRIOR ART)
FIG. 3 is a sectional view showing a conventional scroll-type compressor.

Other structural features are similar to those shown in FIGS. 2A, 2B and 3 relating to the conventional example, and parts in FIGS. 1A and 1B identical to those in FIGS. 2A, 2B, and 3 are given identical reference numbers and explanations thereof are omitted here.

In detail, a portion of the drive bush side of head 40*a* of the float-protecting pin 40 is cut and thus the attachment position of this pin 40 can be closer to the drive bush side by a distance corresponding to a cut portion. Accordingly, the sizes of structural elements in an area neighboring the float-protecting pin 40, such as larger-diameter portion 7*a* of rotating shaft 7 and bearing 9, can be reduced. In addition, the diameter of shaft 40*b* of the float-protecting pin 40 can become larger and thus the strength of the shaft can be increased, or the shaft 40*b* can be firmly fixed to larger-diameter portion 7*a* by screwing the shaft.

Here, if the balance weight 27 floats, then the opposite portion of the head 40*a* of the float-protecting pin 40, that is, a portion (at the side opposite to the drive bush 21) of the outer peripheral area of the back face of the head 40*a* comes into contact with the upper surface 27*a* of balance weight 27. Therefore, it is possible to prevent the balance weight 27 from floating, as in the above-described conventional example.

What is claimed is:

1. A scroll-type fluid machine comprising:

a fixed scroll and a revolving scroll, each scroll comprising an end plate on which a spiral lap is built, and these scrolls are eccentrically engaged in a manner such that both spiral laps are engaged with each other and that phases of these scrolls are different from each other;

a boss provided in and projecting from a central area in a surface of the end plate of the revolving scroll, said surface being opposite to the surface on which the spiral lap is built;

a drive bush inserted into the boss in a freely rotatable form;

a rotational shaft co-rotationally coupled with the revolving scroll via a revolving-radius variable mechanism which includes the boss and the drive bush;

a balance weight attached to the drive bush; and a float-protecting pin, a part of the back face of the head of the pin being in contact with the upper face of the balance weight, the shaft of this pin passing through a hole provided in the balance weight in a freely movable form, and an end part of the shaft being fixed to a larger-diameter portion at one end of the rotational shaft, said larger-diameter portion existing at the drive bush side, and wherein a part of the head of the float-protecting pin, said part existing at the side of the drive bush, is cut.

2. A scroll-type fluid machine as claimed in claim 1, wherein the phases of the fixed and revolving scrolls are different from each other by essentially 180°.

3. A scroll-type fluid machine as claimed in claim 1, wherein a slide groove is cut into the drive bush, and the machine further comprises an eccentric drive pin, as an constituent of the revolving-radius variable mechanism, inserted into the slide groove, and the pin projects and is eccentrically provided on an end face of the larger-diameter portion of the rotational shaft.

4. A scroll-type fluid machine as claimed in claim 1, wherein the drive bush is inserted in the boss in a freely rotatable form via a revolving bearing.

5. A scroll-type fluid machine as claimed in claim 1, wherein the head of the float-protecting pin is cut so that the position of the outer edge at the drive bush side of the head of the float-protecting pin essentially agrees with the corresponding position at the drive bush side of the outer peripheral surface of the shaft of the pin.

* * * * *